US011142950B2

(12) United States Patent
Miller

(10) Patent No.: US 11,142,950 B2
(45) Date of Patent: Oct. 12, 2021

(54) REMOVABLY ATTACHABLE PLATFORM DEVICE

(71) Applicant: Steven Miller, Central Valley, NY (US)

(72) Inventor: Steven Miller, Central Valley, NY (US)

( * ) Notice: Subject to any disclaimer, the term of this patent is extended or adjusted under 35 U.S.C. 154(b) by 377 days.

(21) Appl. No.: 16/263,796

(22) Filed: Jan. 31, 2019

(65) Prior Publication Data

US 2020/0248506 A1 Aug. 6, 2020

(51) Int. Cl.
*E06C 7/16* (2006.01)
*E06C 1/39* (2006.01)

(52) U.S. Cl.
CPC ..... *E06C 7/165* (2013.01); *E06C 1/39* (2013.01)

(58) Field of Classification Search
CPC ..... E06C 7/165; E06C 1/39
See application file for complete search history.

(56) References Cited

U.S. PATENT DOCUMENTS 1,817,760 A 8/1931 Peters
2,827,336 A * 3/1958 Johnson ..... E06C 7/165 182/120
2,867,401 A * 1/1959 Sheahan ..... A47C 7/68 248/231.41
2,899,011 A * 8/1959 Babits ..... E06C 7/165 182/228.3
2,934,162 A * 4/1960 Williams ..... E06C 7/165 182/120
3,078,950 A 2/1963 Schramm
3,112,811 A * 12/1963 Moran ..... E06C 7/08 182/120
3,115,214 A 12/1963 Roberts
3,503,468 A 3/1970 Taylor
3,899,045 A * 8/1975 Geisel ..... E06C 7/16 182/121
4,401,187 A 8/1983 Van Patten
4,437,544 A * 3/1984 Anderson ..... E06C 7/165 182/120
4,909,351 A * 3/1990 Johnson ..... E06C 7/16 182/121
5,388,665 A * 2/1995 Newman ..... E06C 7/16 182/118
5,779,208 A * 7/1998 McGraw ..... E06C 7/165 182/120
D426,896 S 6/2000 Brown
6,786,300 B1 9/2004 Bonifacini
6,966,406 B2 11/2005 Nash, Jr.
9,890,589 B2 * 2/2018 Goodnow ..... E06C 7/16
10,006,248 B2 * 6/2018 Goodnow ..... E06C 7/165

(Continued)

FOREIGN PATENT DOCUMENTS

DE 202019003240 U1 * 8/2019 ..... E06C 7/165

*Primary Examiner* — Colleen M Chavchavadze

(57) ABSTRACT

A removably attachable platform device for use with a ladder includes a base plate, a coupler, and a pair of fasteners. The coupler is coupled to a lower face of the base plate and is configured to removably couple to a respective rung of a ladder to couple the base plate to the rung. Each fastener is coupled to a respective opposing side edge of the base plate and is configured to removably couple to a respective siderail of the ladder to couple the base plate to the siderails of the ladder. The base plate is positioned substantially parallel to a substantially horizontal surface, upon which the ladder is positioned, and thus is configured to support a user.

16 Claims, 5 Drawing Sheets

(56) References Cited

U.S. PATENT DOCUMENTS

| | | | | |
|---|---|---|---|---|
| 10,358,832 | B1 * | 7/2019 | Wagner | E06C 7/165 |
| 2014/0326538 | A1 * | 11/2014 | Najey | E06C 7/08<br>182/129 |
| 2016/0369561 | A1 * | 12/2016 | Jones | E06C 7/08 |

* cited by examiner

REMOVABLY ATTACHABLE PLATFORM DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to platform devices and more particularly pertains to a new platform device for use with a ladder.

BRIEF SUMMARY OF THE INVENTION

An embodiment of the disclosure meets the needs presented above by generally comprising a base plate, a coupler, and a pair of fasteners. The coupler is coupled to a lower face of the base plate and is configured to removably couple to a respective rung of a ladder to couple the base plate to the rung. Each fastener is coupled to a respective opposing side edge of the base plate and is configured to removably couple to a respective siderail of the ladder to couple the base plate to the siderails of the ladder. The base plate is positioned substantially parallel to a substantially horizontal surface, upon which the ladder is positioned, and thus is configured to support a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
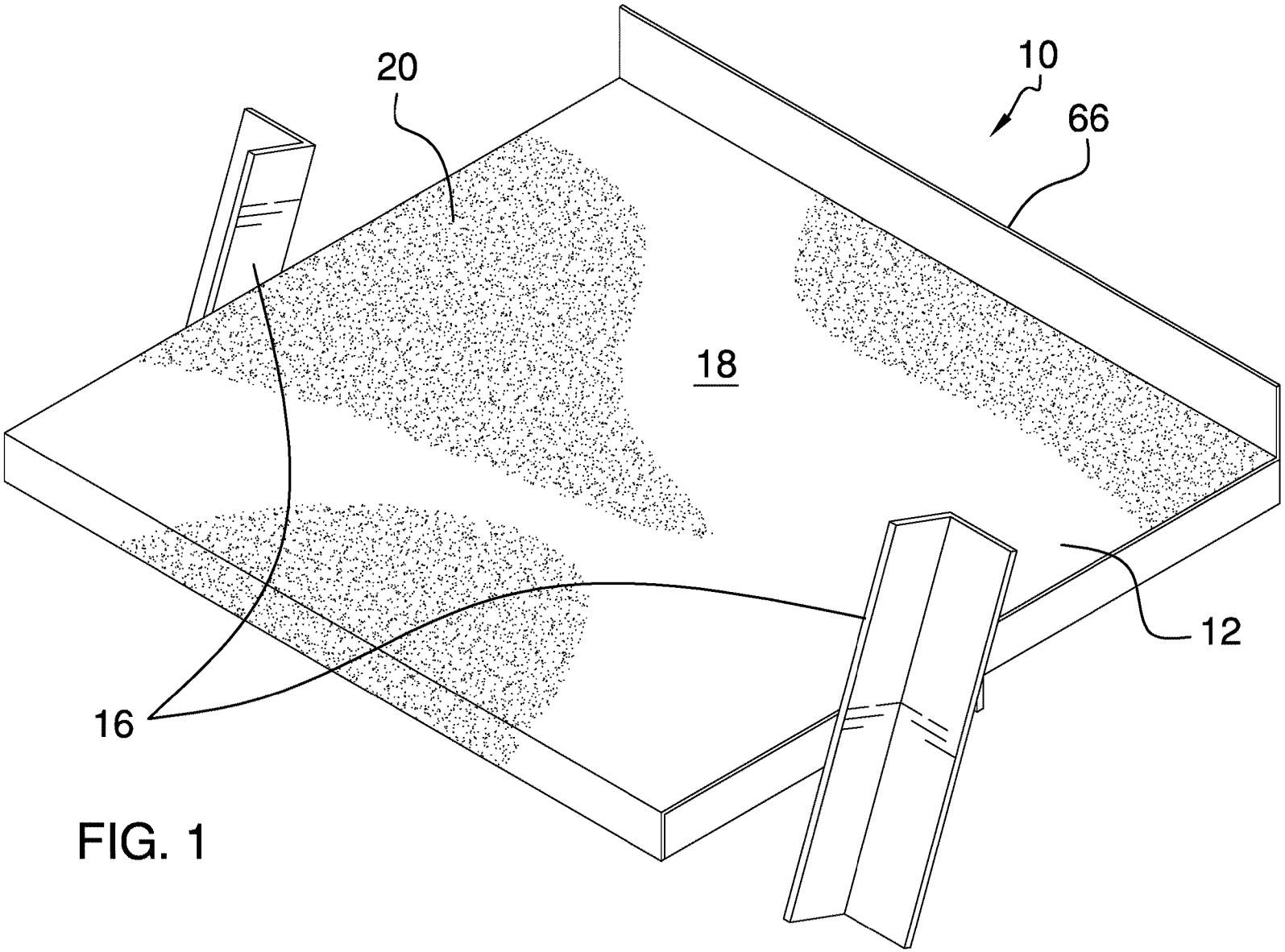
FIG. 1 is an isometric perspective view of a removably attachable platform device according to an embodiment of the disclosure.

With reference now to the drawings, and in particular to FIGS. 1 through 5 thereof, a new platform device embodying the principles and concepts of an embodiment of the disclosure and generally designated by the reference numeral 10 will be described.

As best illustrated in FIGS. 1 through 5, the removably attachable platform device 10 generally comprises a base plate 12, a coupler 14, and a pair of fasteners 16. The base plate 12 is substantially rectangularly shaped and has an upper face 18. The upper face 18 is textured so that the upper face 18 is configured to deter slippage of a foot of a user that is positioned on the upper face 18.

A panel 20 is coupled to the upper face 18 of the base plate 12, as shown in FIG. 1. The panel 20 is textured so that the panel 20 is configured to deter slippage of the foot of the user that is positioned on the upper face 18.

Figure 2:
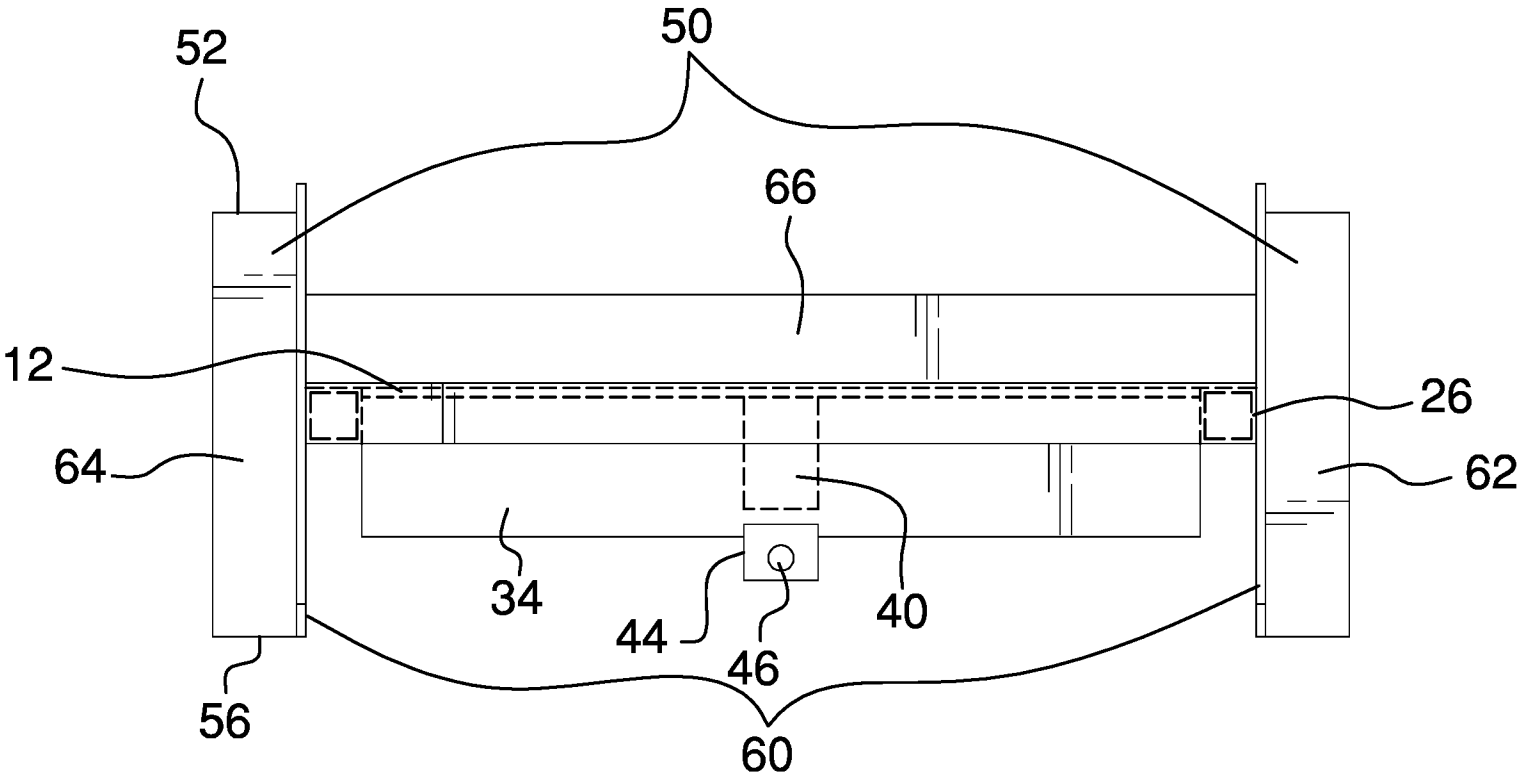
FIG. 2 is a front view of an embodiment of the disclosure.
Figure 3:
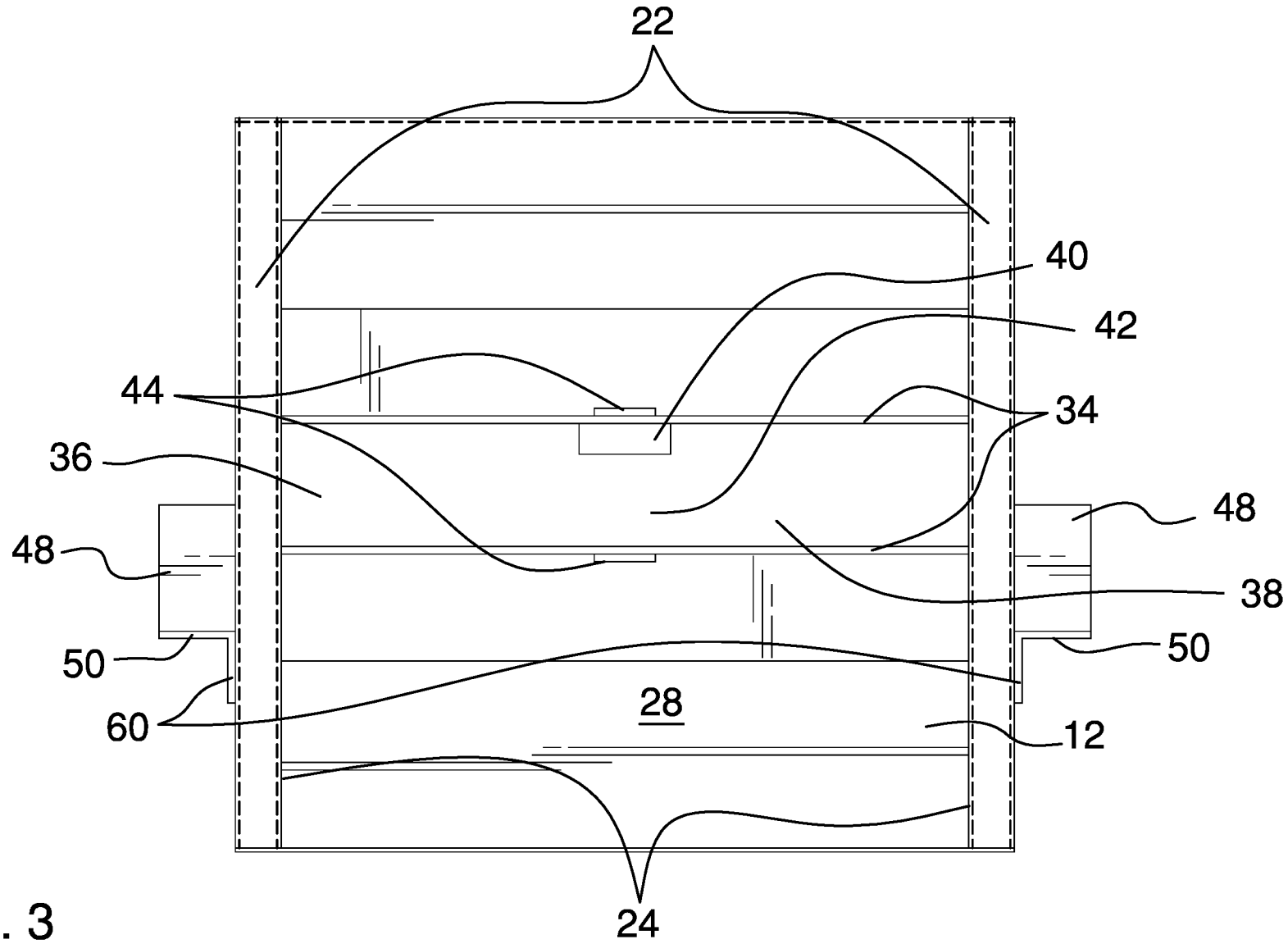
FIG. 3 is a bottom view of an embodiment of the disclosure.
Figure 4:
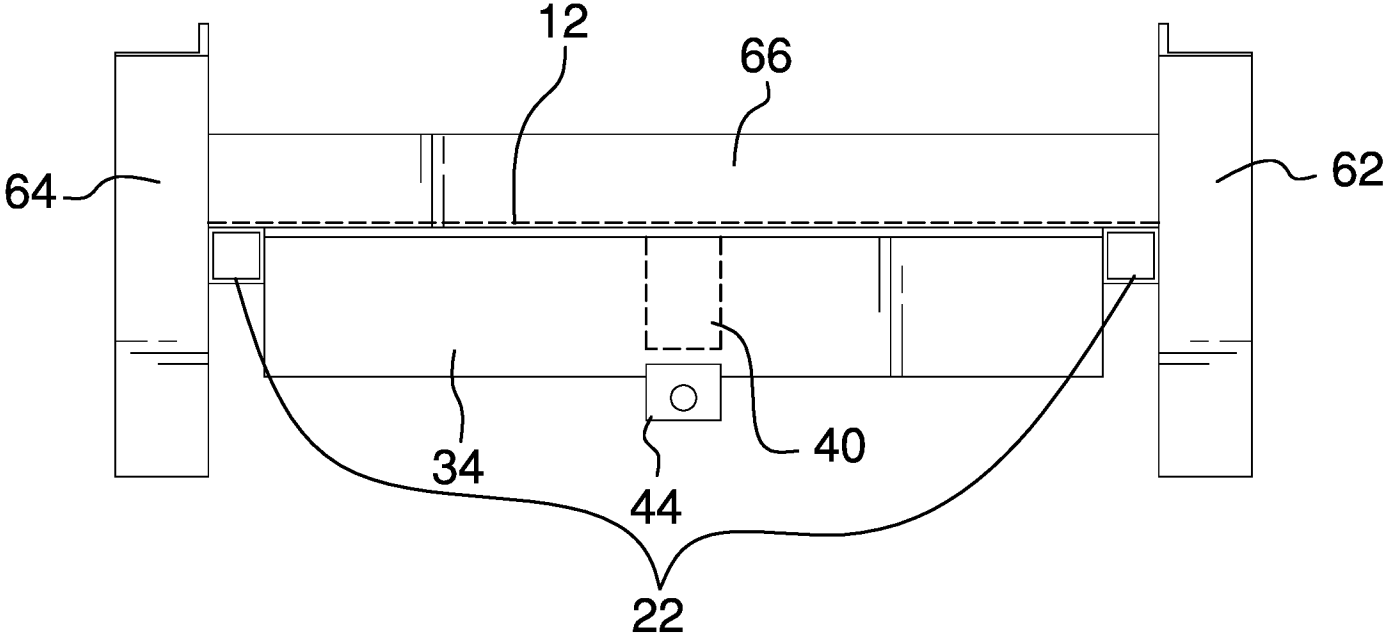
FIG. 4 is a back view of an embodiment of the disclosure.

Each of a pair of rods 22 is coupled to a lower face 28 of the base plate 12 and extends along a respective opposing side edge 24 of the base plate 12, as shown in FIG. 3. The pair of rods 22 is positioned to rigidify the base plate 12. Each rod 22 is tubular and has a cross-sectional profile 26 that is square, as shown in FIG. 2.

The coupler 14 is coupled to the lower face 28 of the base plate 12 and is configured to removably couple to a respective rung 30 of a ladder 32 to couple the base plate 12 to the rung 30. The coupler 14 comprises a pair of slats 34, each of which is coupled to and extends substantially perpendicularly from the lower face 28 of the base plate 12, as shown in FIG. 1. The pair of slats 34 brackets a midline 36 of the base plate 12 to define a channel 38 that is configured to insert the respective rung 30 of the ladder 32. The slats 34 extends from proximate to the opposing side edges 24 of the base plate 12 and are coupled to and extends between the pair of rods 22.

A block 40 is coupled to the lower face 28 of the base plate 12 and a respective slat 34 so that the block 40 is positioned between the pair of slats 34 to define a slot 42. The slot 42 is substantially complementary to the respective rung 30 of the ladder 32 and is configured to insert the respective rung 30 to removably and frictionally couple the base plate 12 to the respective rung 30.

Each of a pair of tabs 44 is coupled to and extends substantially coplanarly from a respective slat 34. Each of a pair of holes 46 is positioned in a respective tab 44. The holes 46 are configured to insert a connector, such as a chain having a pair of clips coupled singly to each end of the chain, to secure the respective rung 30 within the channel 38.

Each fastener 16 is coupled to a respective opposing side edge 24 of the base plate 12 and is configured to removably couple to a respective siderail 48 of the ladder 32 to couple the base plate 12 to the siderails 48 of the ladder 32. The base plate 12 is positioned substantially parallel to a substantially horizontal surface, upon which the ladder 32 is positioned, and thus is configured to support a user.

Figure 5:
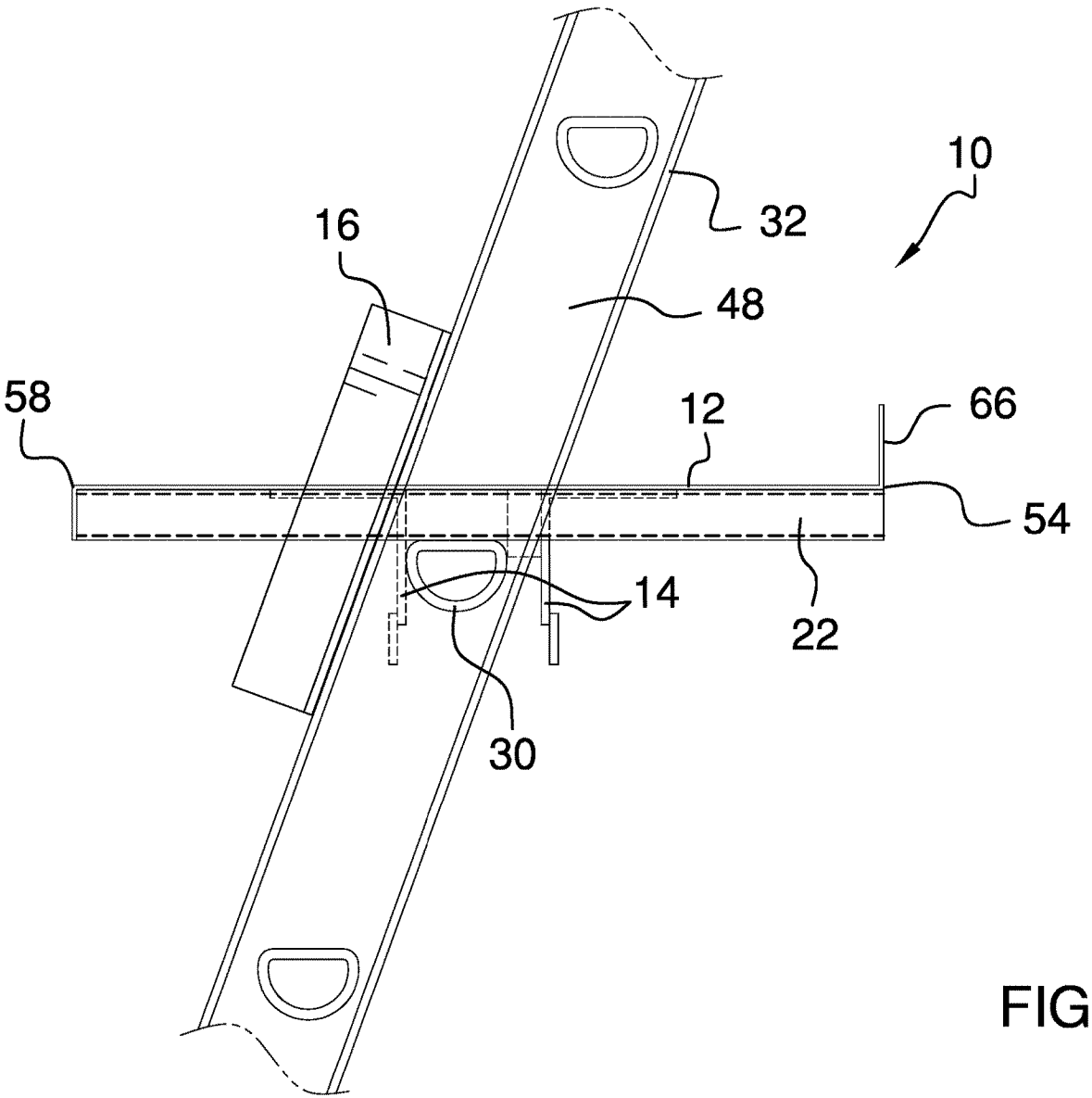
FIG. 5 is an in-use view of an embodiment of the disclosure.

Each fastener 16 comprises an angle plate 50 that is coupled to and which extends transversely from a respective opposing side edge 24 of the base plate 12. An upper end 52 of the angle plate 50 is positioned above the upper face 18 and between the coupler 14 and a front edge 54 of the base plate 12. A lower end 56 of the angle plate 50 is positioned below the lower face 28 and between the coupler 14 and a back edge 58 of the base plate 12. The angle of the angle plate 50 relative to the base plate 12 is substantially equivalent to the angle of the ladder 32 relative to the substantially horizontal surface. The angle plate 50 is configured to abut the respective siderail 48 of the ladder 32, as shown in FIG. 5.

Each of a pair of anchor plates 60 is coupled to and positioned between a respective rod 22 and an associated angle plate 50 so that the anchor plate 60 is perpendicular to the associated angle plate 50. The anchor plate 60 is positioned to rigidify the associated angle plate 50. Each anchor plate 60 and an associated angle plate 50 together comprise an angle bracket 62 or a section of metal angle 64.

A lip plate 66 is coupled to and extends substantially perpendicularly from the front edge 54 of the base plate 12. The lip plate 66 is configured to stop the foot from sliding past the front edge 54 of the base plate 12.

The base plate 12, the pair of rods 22, the coupler 14, the pair of fasteners 16, and the lip plate 66 comprise metal, such as aluminum.

In use, base plate 12 is coupled to the respective rung 30 and the siderails 48 using the coupler 14 and the fasteners 16, respectively, so that the base plate 12 is positioned on the ladder 32 at a desired working height for the user. The user is positioned to ascend the ladder 32 and to stand on the base plate 12 to perform tasks. The base plate 12 provides a level of comfort and safety beyond that provided by the respective rung 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A removably attachable platform device comprising:

a base plate;

a coupler coupled to a lower face of the base plate wherein the coupler is configured for removably coupling to a respective rung of a ladder for coupling the base plate to the rung;

a pair of fasteners, each fastener being coupled to a respective opposing side edge of the base plate wherein the fastener is configured for removably coupling to a respective siderail of the ladder for coupling the base plate to the siderails of the ladder such that the base plate is substantially parallel to a horizontal surface upon which the ladder is positioned wherein the base plate is configured for supporting a user;

a pair of rods coupled to the lower face of the base plate, each rod extending around a respective opposing side edge of the base plate such that the pair of rods is positioned for rigidifying the base plate; and the coupler comprising a pair of slats, each slat being coupled to and extending substantially perpendicularly from the lower face of the base plate such that the pair of slats brackets a midline of the base plate such that the slats define a channel wherein the channel is configured for inserting the respective rung of the ladder, and a block coupled to the lower face of the base plate and a respective slat such that the block is positioned between the pair of slats defining a slot, the slot being substantially complementary to the respective rung of the ladder wherein the slot is configured for inserting the respective rung for removably frictionally coupling the base plate to the respective rung.

2. The device of claim 1, further including the base plate being substantially rectangularly shaped, the base plate having an upper face, the upper face being textured such that the upper face is configured for deterring slipping of a foot of a user positioned on the upper face.

3. The device of claim 1, further including the base plate, the coupler, and the pair of fasteners comprising metal.

4. The device of claim 3, further including the base plate, the coupler, and the pair of fasteners comprising aluminum.

5. The device of claim 1, further including a panel coupled to an upper face of the base plate, the panel being textured such that the panel is configured for deterring slipping of a foot of a user positioned on the upper face.

6. The device of claim 1, further including the rods being tubular, each rod having a cross-sectional profile, the cross-sectional profile being square.

7. The device of claim 1, further including the rods comprising metal.

8. The device of claim 7, further including the rods comprising aluminum.

9. The device of claim 1, further including the slats extending from proximate to the opposing side edges of the base plate, the slats being coupled to and extending between the pair of rods.

10. The device of claim 1, further comprising:

a pair of tabs, each tab being coupled to and extending substantially coplanarly from a respective slat; and a pair of holes, each hole being positioned in a respective tab wherein the holes are configured for inserting a connector for securing the respective rung within the channel.

11. The device of claim 1, further including each fastener comprising an angle plate coupled to and extending transversely from a respective opposing side edge of the base plate such that an upper end of the angle plate is positioned above an upper face of the base plate and between the coupler and a front edge of the base plate and wherein a lower end of the angle plate is positioned below the lower face and between the coupler and a back edge of the base plate wherein the angle plate is configured for abutting the respective siderail of the ladder.

12. The device of claim 11, further including a pair of anchor plates, each anchor plate being coupled to and positioned between a respective rod and an associated angle plate such that the anchor plate is perpendicular to the associated angle plate wherein the anchor plate is positioned for rigidifying the associated angle plate.

13. The device of claim 1, further including a lip plate coupled to and extending substantially perpendicularly from a front edge of the base plate wherein the lip plate is configured for stopping the foot from sliding past the front edge of the base plate.

14. The device of claim 13, further including the lip plate comprising metal.

15. The device of claim 14, further including the lip plate comprising aluminum.

16. A removably attachable platform device comprising:

a base plate; the base plate being substantially rectangularly shaped, the base plate having an upper face, the upper face being textured such that the upper face is configured for deterring slipping of a foot of a user positioned on the upper face, the base plate comprising metal, the base plate comprising aluminum;

a panel coupled to the upper face of the base plate, the panel being textured such that the panel is configured for deterring slipping of a foot of a user positioned on the upper face;

a pair of rods coupled to the lower face of the base plate, each rod extending around a respective opposing side edge of the base plate such that the pair of rods is positioned for rigidifying the base plate, the rods being tubular, each rod having a cross-sectional profile, the cross-sectional profile being square, the rods comprising metal, the rods comprising aluminum;

a coupler coupled to the lower face of the base plate wherein the coupler is configured for removably coupling to a respective rung of a ladder for coupling the base plate to the rung, the coupler comprising metal, the coupler comprising aluminum, the coupler comprising:

a pair of slats, each slat being coupled to and extending substantially perpendicularly from the lower face of the base plate such that the pair of slats brackets a midline of the base plate such that the slats define a channel wherein the channel is configured for inserting the respective rung of the ladder, the slats extending from proximate to opposing side edges of the base plate, the slats being coupled to and extending between the pair of rods, a block coupled to the lower face of the base plate and a respective slat such that the block is positioned between the pair of slats defining a slot, the slot being substantially complementary to the respective rung of the ladder wherein the slot is configured for inserting the respective rung for removably frictionally coupling the base plate to the respective rung, a pair of tabs, each tab being coupled to and extending substantially coplanarly from a respective slat, and a pair of holes, each hole being positioned in a respective tab wherein the holes are configured for inserting a connector for securing the respective rung within the channel;

a pair of fasteners, each fastener being coupled to a respective opposing side edge of the base plate wherein the fastener is configured for removably coupling to a respective siderail of the ladder for coupling the base plate to the siderails of the ladder such that the base plate is substantially parallel to a horizontal surface upon which the ladder is positioned wherein the base plate is configured for supporting the user, the pair of fasteners comprising metal, the pair of fasteners comprising aluminum, each fastener comprising an angle plate coupled to and extending transversely from a respective opposing side edge of the base plate such that an upper end of the angle plate is positioned above the upper face and between the coupler and a front edge of the base plate and wherein a lower end of the angle plate is positioned below the lower face and between the coupler and a back edge of the base plate wherein the angle plate is configured for abutting the respective siderail of the ladder;

a pair of anchor plates, each anchor plate being coupled to and positioned between a respective rod and an associated angle plate such that the anchor plate is perpendicular to the associated angle plate wherein the anchor plate is positioned for rigidifying the associated angle plate; and a lip plate coupled to and extending substantially perpendicularly from the front edge of the base plate wherein the lip plate is configured for stopping the foot from sliding past the front edge of the base plate, the lip plate comprising metal, the lip plate comprising aluminum.

* * * * *